United States Patent [19]

Kowalik

[11] 4,357,503

[45] Nov. 2, 1982

[54] BLADE-ADJUSTMENT DEVICE FOR A DISCONNECTING-SWITCH STRUCTURE

[75] Inventor: Peter M. Kowalik, Trafford, Pa.

[73] Assignee: Cleaveland/Price, Enterprises, Inc., Trafford, Pa.

[21] Appl. No.: 219,378

[22] Filed: Dec. 22, 1980

[51] Int. Cl.[3] ..... H01H 31/30

[52] U.S. Cl. ..... 200/48 A

[58] Field of Search ..... 200/48 R, 48 KB, 48 A, 200/329, 335, 337, 338

[56] References Cited

U.S. PATENT DOCUMENTS

| | | | |
|---|---|---|---|
| 2,579,771 | 12/1951 | Warren et al. | 200/48 R |
| 2,688,666 | 9/1954 | Gilliland et al. | 200/48 A |
| 2,944,101 | 7/1960 | Albright | 200/48 R |
| 4,233,483 | 11/1980 | Rogers | 200/337 |

*Primary Examiner*—John W. Shepperd
*Attorney, Agent, or Firm*—Willard R. Crout

[57] ABSTRACT

An improved simple adjustment device is provided for each of several disconnecting switch structures enabling an independent positioning of the blade-assemblies in the open and closed positions, by an adjustment of a tongue-member, which is incorporated in the operating arm assembly by adjustment bolts. Inward and outward movement of the tongue-member in the operating crank-assembly will effect only the closed position of the switch-blade assembly. Once this is made, right and left adjustment of the same tongue-member will correspondingly effect only the open position of the blade-assemblies. The aforesaid tongue-member is pivotally connected to the link-member interconnecting the blade-assembly, and it is provided with one or more elongated adjustment slots to permit the aforesaid adjustment movement in or out, and to the right or left for independent adjustment of both the open and closed circuit positions of the several blade-assemblies. As a result, the three blade-assemblies of a three-phase disconnecting switch may be so adjusted as to position all of the movable blade-assemblies in the same vertical plane in the fully opened position of the disconnecting switch structure. Similarly, the three blade-assemblies may be adjusted so that they simultaneously engage the stationary switch-jaw contacts in the closed circuit position of the device, thereby giving complete contact of all three movable blades in the closed position and yet pleasing alignment of all three movable blades in the vertical open position of the switch.

12 Claims, 5 Drawing Figures

II
II
1
23
23a
23b
38
38
32
30
39
28
29
25
27
26
17
15
13
11
OPEN
9
7
5
3
21
19

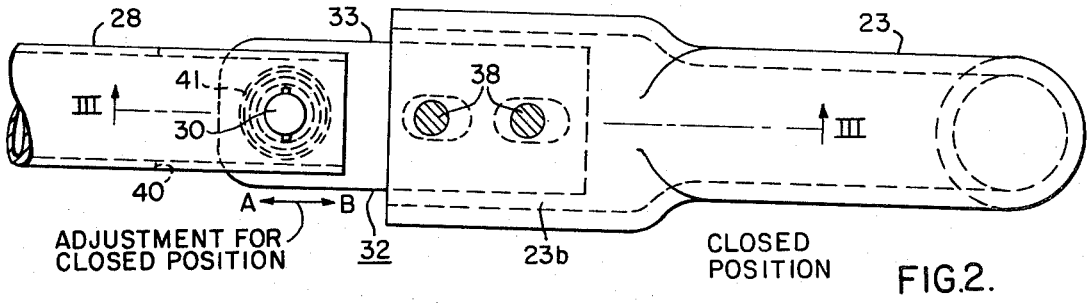
FIG.2.
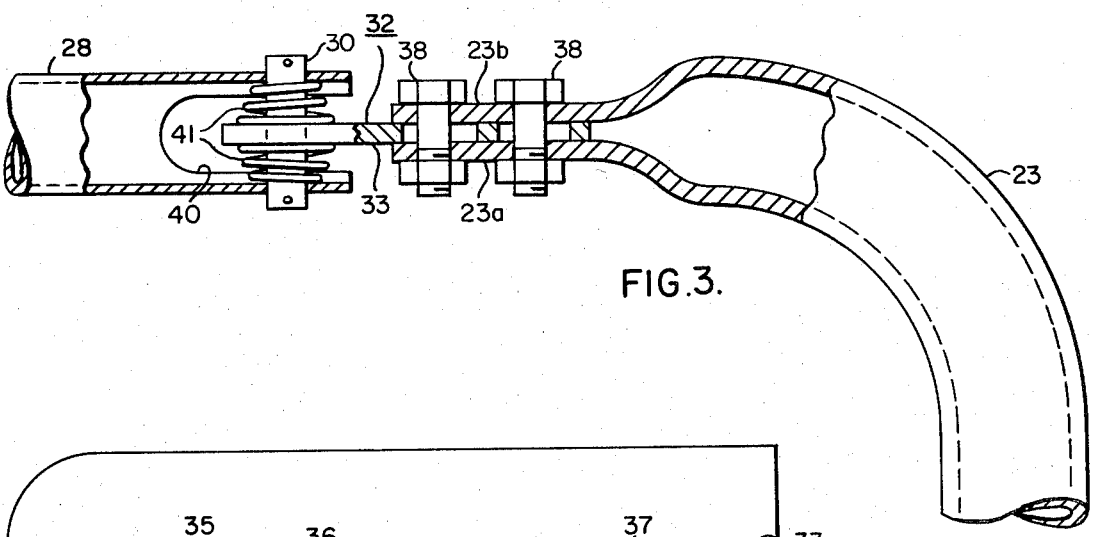
FIG.3.
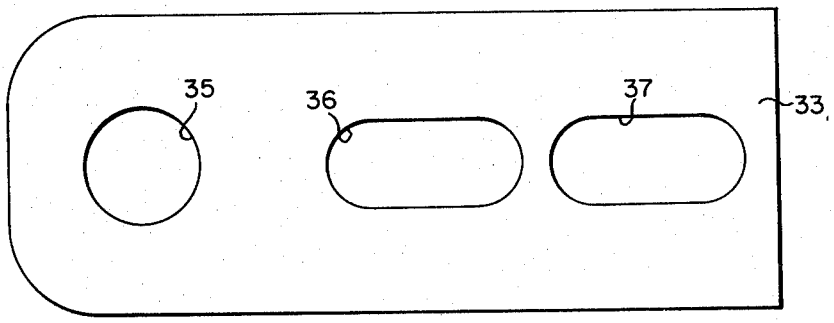
FIG.4.
FIG.5.
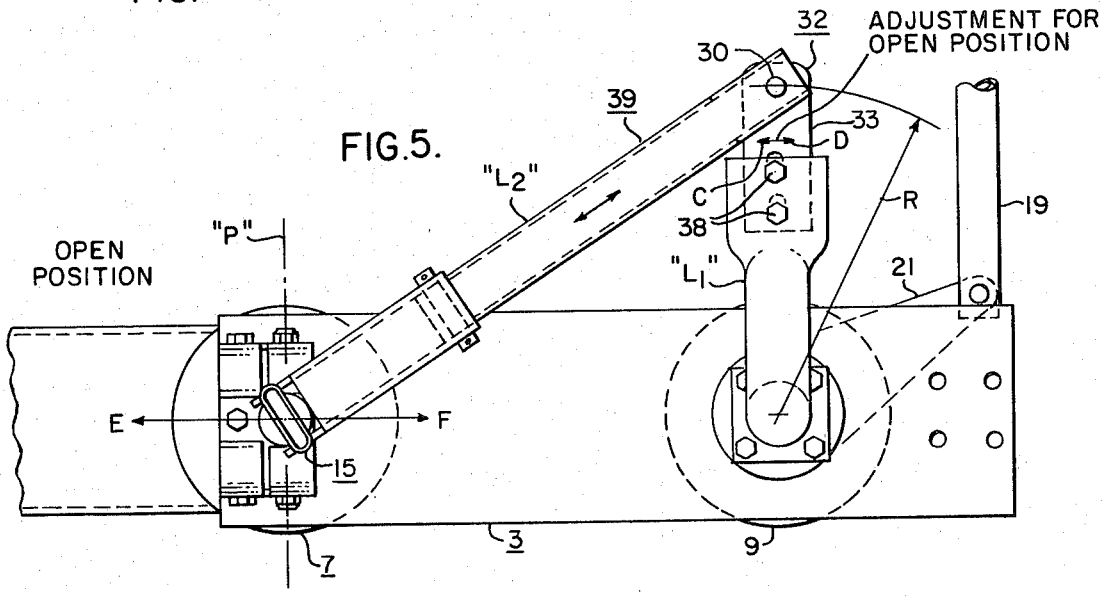

BLADE-ADJUSTMENT DEVICE FOR A DISCONNECTING-SWITCH STRUCTURE

BACKGROUND OF THE INVENTION

1. Field of the Invention

This invention relates to electrical disconnecting switch structures in which a swinging movable disconnecting switch-blade moves into and out of electrical contacting engagement with a stationary disconnecting switch contact. It is particularly useful when adjusting the several movable switch-blades of a multi-phase disconnecting switch assembly, so that a plurality of swinging movable switch-blades will make closed electrical contacting engagement with their respective stationary contact structures at approximately the same time. Moreover, with the novel adjustment device of the present invention, the several movable switch-blades may be all aligned in a single opening plane in the open position of the multi-phase disconnecting switch structure.

2. Description of the Prior Art

Multi-phase disconnecting switches of the prior art have generally been supplied with individual stops to limit travel of the individual movable switch-blades in the open position of the switch, with no adjustment capability associated with such individual stops to additionally control the closed end terminating position of the individual movable switch-blades. In addition, the adjustment devices associated with multi-phase disconnecting switches of the prior art were complicated, expensive and difficult for the maintenance personnel to manually adjust.

SUMMARY OF THE INVENTION

The present invention relates to a novel blade-adjustment device for a disconnecting switch, which enables the fully-opened position of the switch to be independently adjusted from the closed position of the switch by a novel adjustment means, such as a tongue-member, which adjustably provides independent adjustment of both the opened and closed circuit positions of the rotating blade-member. The foregoing adjustment device is particularly desirable for three-phase disconnecting switch structures, which have, for example, three movable blade assemblies, which preferably are aligned in the open position of the three-phase disconnecting switch in one vertical plane, which is also preferable for appearances sake. Also, it is moreover desirable to have the three blade-assemblies of a three-phase disconnecting switch engage the respective closed switch-jaw contact structures at generally the same point in time so as to electrically close the controlled circuits simultaneously and, more importantly, to be sure each movable blade assembly is fully engaged and in complete contact with the respective stationary jaw contact structure when the three-phase disconnecting switch is closed.

A general object of the present invention is to provide a novel, simplified adjustment means, or device for a disconnecting switch structure so as to provide an independent adjustable closed position and an independent adjustable open position for the movable blade-assembly in a very simple manner.

An additional object of the present invention is to provide an improved adjustment device for independently adjusting the closed and open end positions of the movable blade-assembly in a very economical manner.

Still a further object of the present invention is to provide an improved adjustable device for operating the movable blade-assemblies of a three-phase disconnecting switch structure, so that the three movable switch-blades of the three-phase switching structure may be aligned in a single vertical plane in the fully-opened circuit position of the device without effecting the adjustment of the movable blades in the closed position.

Still a further object of the present invention is the provision of an improved adjustment device incorporated in the operating linkage of the movable switch-blade assemblies, so that the three switch-blade assemblies will be moved toward the closed circuit positions simultaneously, and will reach a "home" end closed position in unison and this adjustment does not effect the adjustment of the movable blades in the vertical open position of the switch.

In accordance with the present invention, there is provided an adjustment device, such as a tongue member, for example, which is incorporated in the operating linkage causing the operation of each of the movable blade-assemblies, so that by an adjustment of each individual tongue member in different directions thereof, an independent positioning of the end open and closed circuit positions of the movable blade-assemblies is thereby achieved.

BRIEF DESCRIPTION OF THE DRAWINGS

FIG. 2 is an enlarged fragmentary plan view as seen generally along the line II—II of FIG. 1 looking in the direction of the arrows;

FIG. 3 is a vertical sectional view taken substantially along the line III—III of FIG. 2 looking in the direction of the arrows;

FIG. 4 is an enlarged detailed plan view of the adjustment device, or tongue member, which constitutes a part of the improved adjustment means of the present invention; and, FIG. 5 is a fragmentary top plan view, generally taken along the line II—II of FIG. 1, but illustrating the position of the operating links in the fully-opened circuit position of the disconnecting switch structure of FIG. 1.

DESCRIPTION OF THE PREFERRED EMBODIMENT

Figure 1:
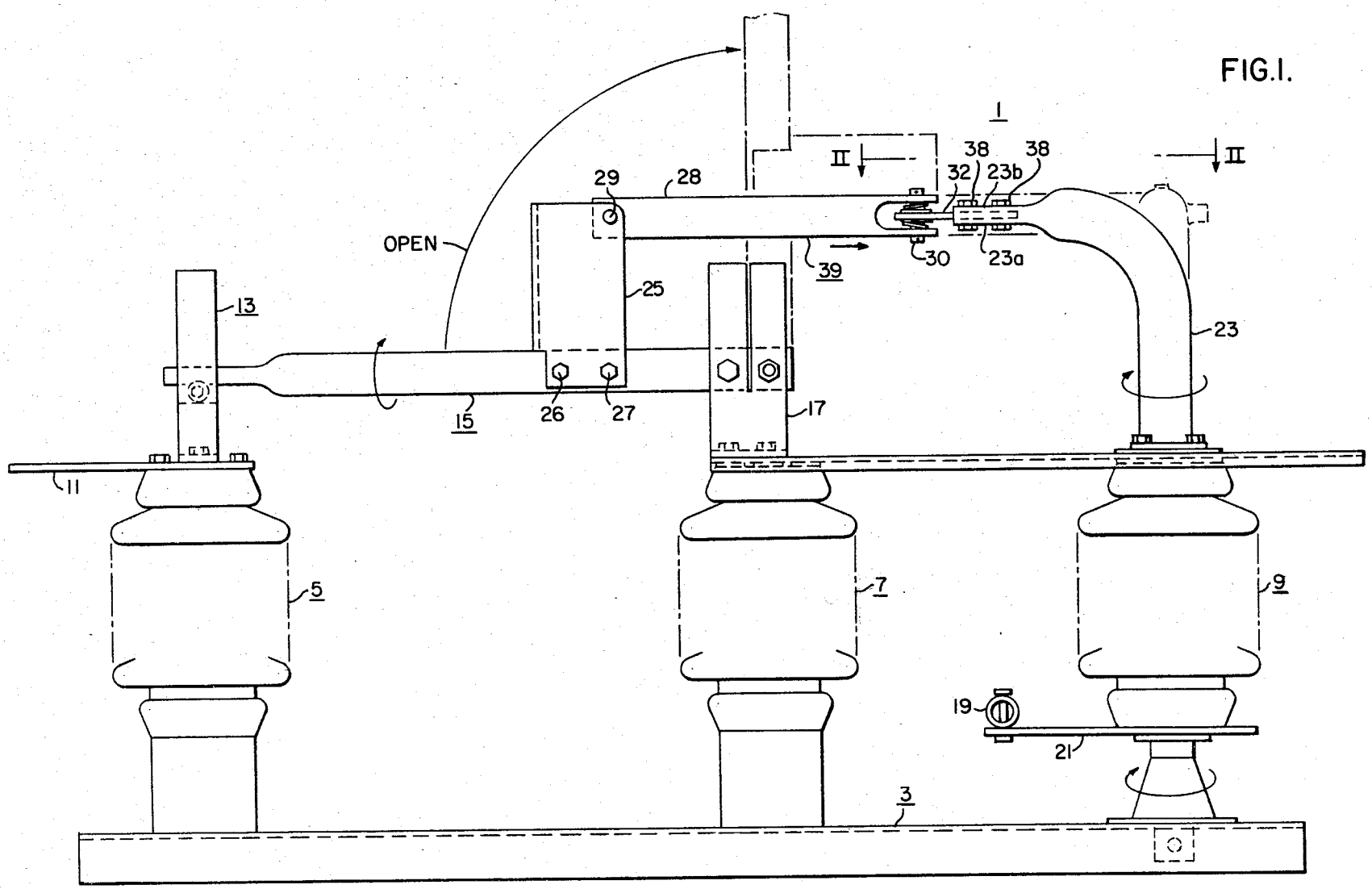
FIG. 1 is a side elevational view of a disconnecting switch structure embodying features of the present invention, the movable contact-blade being illustrated in the closed circuit position.

Referring to the drawings and more particularly to FIG. 1 thereof, the reference numeral 1 generally designates a disconnecting switch structure having a base portion 3 of generally inverterd channel-shaped construction, and having supported upwardly therefrom three post-type insulators 5, 7 and 9. At the upper end of the left-hand post insulator 5 is a line-terminal connection 11 and also a stationary U-shaped switch-jaw contact assembly 13. Making electrical contacting engagement with the stationary U-shaped switch-jaw contact assembly 13 is a movable switch-blade assembly 15, the latter being pivotally mounted about a stationary switchcontact assembly 17, the general details of which are more readily apparent from an inspection of FIG. 1.

As illustrated in FIG. 1, the right-hand post-insulator support 9 is capable of rotative operative motion, as effected by an interconnecting operating-pipe assembly 19, which interconnects three such disconnecting switch structures 1, each of which is of the general type illustrated in FIG. 1. Thus, it will be noted that operation of the crank-assembly 21 will correspondingly effect rotation of the right-hand post-insulator assembly 9 and therefore consequent swinging opening rotative motion of the movable operating crank 23 to a generally-open circuit position, as illustrated in FIG. 5 of the drawings.

To mechanically interconnect the operation of the movable blade-assembly 15 with rotation of the right-hand post-insulator assembly 9, it will be observed that there is provided a movable blade-arm 25, which may be secured, by a pair of mounting bolts 26 and 27, to the horizontally extending movable blade-assembly 15. At the upper end of the movable blade-arm 25, is pivotally connected a link 28 by means of a pivot pin 29. The right-hand end of the link 28 as more clearly illustrated in FIG. 3, is pivotally connected by a pivot pin 30 to an adjustment means, generally designated by the reference numeral 32, such as a tongue member 33, for example, which is illustrated more clearly to an enlarged scale in FIG. 4 of the drawings.

The tongue member 33 is inserted between flattened horizontal portions 23*a* and 23*b* of a movable tubular crank-member 23, which is, as mentioned, rotated by operating rotation of the rotatable post-insulator assembly 9.

With reference to FIGS. 2 and 3 of the drawings, it will be observed that the tongue member 33 has a pair of elongated adjustment slots 36 and 37 provided therein, through which pass mounting bolts 38 for adjustable positioning of the tongue member 33. Thus, inward and outward movement of the tongue-member 33, as illustrated by the arrows "A" and "B" of FIG. 2, will effect the closed, end, terminating position of the movable blade-assembly 15, as illustrated more clearly in FIG. 1 of the drawings. Thus, with reference to FIG. 2, it will be observed that movement of the tongue-member 33 in the direction "A" of FIG. 2, for example, will effect a further closing movement of the movable blade-assembly 15. Correspondingly, movement of the tongue-member in the opposite direction, that is in the direction of the arrow "B" of FIG. 2 will correspondingly raise the left-hand free end of the movable blade-assembly 15 to thereby effect the terminating closed end position thereof.

It will also be observed, with reference to FIG. 5, that the vertical position of each of the movable blade-assemblies 15 of, for example, a three-phase disconnecting switch structure 1 (not shown) so that all of the three blade-assemblies 15 are disposed in the same vertical plane "P" (FIG. 5), may be accomplished by an adjustment of the three tongue-members 33 of the three disconnecting switch structures 1. For example, if the tongue-member 33 of a particular switch 1 is moved laterally, as allowed by the width of the oversized adjustment slots 36 and 37, in the direction of the arrow "D" of FIG. 5, this will move the vertical position of the movable blade-assembly 15 toward the right in the direction of the arrow "F" of FIG. 5. Similarly, if in FIG. 5 the tongue-member 33 is moved in the direction of the arrow "C" of FIG. 5, this will correspondingly cause the vertical position of the movable blade-assembly 15 to be moved in the direction of the arrow "E" of FIG. 5.

It should be noted that the most novel feature of this invention is the fact that when the tongue 33 is moved in the "C" or "D" direction for adjusting the vertical position of the blade assembly 15, it does not effect the closed position because the radius "R", as shown in FIG. 5, has not appreciably changed. Only when the tongue 33 is moved in the "A" or "B" direction does the radius "R" of FIG. 5 change, which, in turn, effects the closed position of the movable blade 15. This allows a three-phase switch to be properly adjusted with all three blades 15 adjusted completely closed and all three blades 15 adjusted to a vertical open position.

There are no switches, to the knowledge of those skilled in the art, which have an adjustment to align the three blades 15 of a three-phase disconnecting switch in a vertical open position while not effecting the adjustment in the closed position of the switch. It is electrically important to have all three blades 15 completely closed to make proper contact; however, due to inaccuracies in mounting and manufacturing the three switch phases, when the switch phases are opened, the three blades 15 do not come into vertical alignment and the resultant appearance is not pleasing.

From the foregoing description, it will be apparent that there has been provided a simple, inexpensive adjusting device for independently adjusting the closed and opened end circuit positions of the three blade-assemblies 15 of a three-phase disconnecting switch structure. By the use of a single tongue-member 33, not only may the closed position of the blade-assembly 15 be effected by an inward or outward movement of the tongue-member 33 into or out of the flattened end portions 23*a*, 23*b* of the operating crank 23, but when this adjustment is once made, merely a slight tapping of the tongue-member 33 to the right or to the left in the direction of the arrows "C" and "D" of FIG. 5 may adjust the open circuit position of the movable blade-assemblies 15. The two adjustment positions, namely the opened and closed positions, may be thereby effected by a single adjustment means 32, or the tongue-member 33 in the manner illustrated and described hereinabove.

Although there has been illustrated and described a specific disconnecting switch structure, it is to be clearly understood that the same was merely for the purpose of illustration, and that changes and modifications may readily be made therein by those skilled in the art, without departing from the spirit and scope of the invention.

What is claimed is:

1. A disconnecting switch of the type having a swinging disconnecting switch-blade (15) cooperable with a stationary switch-jaw contact (13), in combination, operating means for said disconnecting switch including a rotatable crank-arm means (23) having an outer free-end portion, an adjustment means (32) having an adjustable mechanical connection with said outer free-end portion of the rotatable crank-arm means (23), operating linkage-means mechanically interconnecting said swinging disconnecting switch-blade with said adjustment means, said adjustment means having a longitudinal adjustment connection with said rotatable crank-arm means (23) for thereby independently determining the end closing position of said swinging disconnecting switch-blade (15) with respect to said stationary switch-jaw contact (13), said adjustment means additionally having an angular adjustment connection with said rotatable crank-arm means (23) for thereby also independently determining the end opening position of said swinging disconnecting switch-blade (15).

2. The combination according to claim 1, wherein said adjustment means (32) comprises a relatively flat tongue member (33).

3. The combination according to claim 2, wherein the relatively flat tongue member (33) has an enlarged adjustment slot provided therein, and one or more adjustment bolts are provided to pass through the enlarged adjustment slot to thereby fixedly secure the relatively flat tongue member (33) in its adjusted final position.

4. The combination according to claim 2, wherein the outer free-end portion of the rotatable crank-arm means (23) comprises a flattened metallic tubular member to engage with said tongue member (33).

5. The combination according to claim 4, wherein the rotatable crank-arm means (23) comprises a rotatable post-insulator support having affixed to one end thereof said rotatable tubular member, and said tubular member (23) having generally a right-angled configuration.

6. The combination according to claim 2, wherein said operating linkage means includes an elongated link (28) having a pivotal mechanical connection with one end of said relatively flat tongue member (33).

7. The combination according to claim 1, wherein said operating linkage means includes an elongated link (28) having a pivotal mechanical connection (30) with one end of said adjustment means (32).

8. A disconnecting switch of the type having a swinging disconnecting switch-blade (15) cooperable with a stationary switch-jaw contact (13), in combination, operating means for operating said disconnecting switch including a right-angled rotatable crank-arm means (23) constituting one leg "$L_1$" of said operating means, adjustment means (32) associated with said one leg "$L_1$" including an extensible member (33), whereby the length of said one leg of the operating means may be adjustably varied to thereby independently determine the end closing position of the swinging disconnecting switch-blade (15) with respect to the stationary switch-jaw contact (13), and said adjustment means (32) being capable of being tilted by itself without changing the length of said one leg "$L_1$" of the operating means to thereby determine the end opening position of the swinging disconnecting switch-blade (15) without changing the end closed position of the swinging disconnecting switch-blade (15).

9. The combination according to claim 8, wherein the adjustment means (32) comprises a relatively flat tongue member (33) having at least one enlarged adjustment slot (36, 37) provided therein together with a mounting bolt (38) to fix the position of the relatively flat tongue member (33) relative to said one leg "$L_1$" following an adjustment operation.

10. The combination according to claim 9, wherein the relatively flat tongue member (33) has a pivot hole (35) provided therein adjacent the outer free end thereof to thereby make a movable pivotal connection (30) with the other leg "$L_2$" of said operating means.

11. The combination according to claim 10, wherein the other leg of the operating means has an open slot (40) provided therein, and a pivot pin pivotally interconnects said one leg "$L_1$" of the operating means with the slotted other leg "$L_2$" of the operating means.

12. The combination according to claim 11, wherein the open slot (40) of the other leg "$L_2$" of the operating means is relatively wide in the direction of the pivot pin (30), and a pair of compression springs (41) surround the pivot pin (30) on opposite sides of the relatively flat tongue member (33), whereby a somewhat flexible loose pivotal connection (30) is thereby obtained between the two legs "$L_1$", "$L_2$" of the operating means.

* * * * *